United States Patent [19]

Van Engen et al.

[11] Patent Number: 4,922,157

[45] Date of Patent: May 1, 1990

[54] ELECTRODELESS LOW-PRESSURE DISCHARGE LAMP WITH THERMALLY ISOLATED MAGNETIC CORE

[75] Inventors: Pieter G. Van Engen; Anthony Kroes, both of Eindhoven, Netherlands

[73] Assignee: U.S. Philips Corp., New York, N.Y.

[21] Appl. No.: 204,143

[22] Filed: Jun. 8, 1988

[30] Foreign Application Priority Data

Jun. 26, 1987 [NL] Netherlands ..... 8701495

[51] Int. Cl.[5] ..... H05B 41/16

[52] U.S. Cl. ..... 315/248; 315/57; 315/344; 315/39; 313/492; 313/493

[58] Field of Search ..... 315/248, 344, 57, 39; 313/492, 493, 644, 488

[56] References Cited

U.S. PATENT DOCUMENTS

| | | | |
|---|---|---|---|
| 4,119,889 | 10/1978 | Hollister | 315/248 |
| 4,247,800 | 1/1981 | Proud et al. | 315/248 |
| 4,437,041 | 3/1984 | Roberts | 315/248 |
| 4,455,508 | 6/1984 | Wesselink | 313/493 |
| 4,622,495 | 11/1986 | Smeelen | 315/248 |
| 4,727,294 | 2/1988 | Houkes et al. | 315/248 |
| 4,727,295 | 2/1988 | Postma et al. | 315/248 |

*Primary Examiner*—Leo H. Boudreau
*Assistant Examiner*—Michael Razavi
*Attorney, Agent, or Firm*—Emmanuel J. Lobato

[57] ABSTRACT

The electrodeless low-pressure discharge lamp comprises a discharge vessel (1) having an inwardly extending protuberance (2) and an evacuated outer bulb (5) having a protuberance (6) projecting into the protuberance (2). A soft magnetic body (3) is arranged in the protuberance (6). It is a heat-resistant envelope (22) and is surrounded by an electrical coil (4) outside the envelope (22).

14 Claims, 1 Drawing Sheet

ELECTRODELESS LOW-PRESSURE DISCHARGE LAMP WITH THERMALLY ISOLATED MAGNETIC CORE

BACKGROUND OF THE INVENTION

The invention relates to improvements in an electrodeless low-pressure discharge lamp comprising a discharge vessel sealed in a vacuum-tight manner and having a discharge space containing ionizable vapor and rare gas, and the discharge vessel having an inwardly extending protuberance for receiving a body of soft magnetic material cooperating with an electrical coil surrounding the magnetic body.

Such a lamp is known from GB No. 2 133 612 A and corresponding U.S. Pat. No. 4,568,859.

The known lamp is a low-pressure mercury discharge lamp. Low-pressure mercury discharge lamps have a comparatively low operating temperature. An optimum efficiency is attained if the lowest temperature of the discharge is about 40°-90° C. An attractive property of the known electrodeless lamp is that the discharge vessel has only small dimensions as compared with lamps having electrodes and are not constrained to have a tubular elongate discharge vessel. The light produced by a compact lamp, such as the known electrodeless lamp, can readily be concentrated by a luminaire.

Like low-pressure mercury discharge lamps having electrodes, low-pressure sodium discharge lamps have an elongate tubular discharge vessel. Also in these sodium lamps, a compact lamp vessel would be advantageous.

However, low-pressure sodium lamps have an optimum efficiency at a comparatively high operating temperature. The lowest temperature of the discharge vessel is then about 260° C.

In order to attain this comparatively high minimum temperature, the discharge vessel in the conventional low-pressure sodium discharge lamps provided with electrodes is arranged inside an evacuated outer bulb.

Soft magnetic materials, such as ferrites, have a low resistance to heat. With increasing temperature, the specific magnetic losses increase, while at an elevated temperature moreover the magnetic permeability of the materials starts to decrease. As a result, the efficiency of electrodeless lamps containing said materials is lower.

For low-pressure sodium discharge lamps, which cannot be equalled by any other lamp type from a viewpoint of efficient conversion of electrical energy into visible radiation, and for other lamps containing an ionizable vapor at a comparatively low vapor pressure, such as metal halide, for example $AlCl_3$, $SnCl_2$, there are consequently factors contrasting with each other. In order that the light generated by a lamp can be fully utilized by a luminaire cooperating with said lamp, the lamp has to be compact. An electrodeless lamp is very suitable for this purpose. For a high efficiency, the discharge vessel has to be surrounded by an outer bulb in order to thermally isolate the discharge. In the other hand, a body of soft magnetic material in an electrodeless low-pressure discharge lamp is already thermally heavily loaded and this thermal load becomes even higher if the lamp is surrounded by an outer bulb and is consequently thermally isolated from the environment.

SUMMARY OF THE INVENTION

The invention has for its object to provide an electrodeless discharge lamp of the kind mentioned in the opening paragraph, which has a comparatively high efficiency.

According to the invention, this object is achieved in an electrodeless low-pressure discharge lamp of the kind mentioned in that the discharge vessel is surrounded by an evacuated outer bulb, and the outer bulb has a protuberance projecting into the protuberance of the discharge vessel so that the body of soft magnetic material can be received by said protuberance in the outer bulb.

The embodiment of the low-pressure discharge lamp according to the invention, which is provided with sodium vapor, is particularly suitable for use in public illumination and safety illumination. The lamp has a high efficiency due to the fact that electrical energy is efficiently converted into visible radiation of a wavelength to which the eye is very sensitive. The light emitted by the lamp can moreover be readily concentrated by a luminaire.

The high efficiency of the lamp is also attained by the fact that the body of soft magnetic material is not situated within the thermal isolation structure of the discharge vessel. This thermal isolation structure, i.e. the evacuated outer bulb surrounding the discharge vessel, thus separates a body of soft magnetic material provided in the protuberance of the outer bulb from the hot discharge.

The outer bulb may be provided at its inner surface with a translucent coating reflecting IR radiation, for example of tin-doped indium oxide, for increasing the thermal isolation of the discharge vessel.

It is favorable to provide the wall of at least one of the protuberances with a specularly or non-specularly reflecting layer, consisting, for example, of $Al_2O_3$. Radiation directed inwardly is then reflected outwardly, which has a favorable effect on the light output of the lamp.

The lamp according to the invention may be formed as an integrated lamp unit in that the lamp is fixed with its outer bulb in a housing provided with a lamp holder with contacts. This housing surrounds a power supply unit comprising a frequency converter having an output frequency of at least 1 MHz and connected to contacts at the lamp cap and to the electrical coil surrounding the soft magnetic body.

In the lamp according to the invention, a soft magnetic body may be used having a core of material not magnetizable in the operating conditions, such as, for example, copper, in order to regulate the temperature of the body. The body may be mounted at its end remote from the discharge on a body of synthetic material, for example polycarbonate or fluorinated hydrocarbon polymer, such as teflon, in order to limit heat transport to a housing connected to the outer bulb and accommodating the power supply unit.

In a particular embodiment of the lamp according to the invention, the electrical coil for cooperation with the soft magnetic body is present in the evacuated space between the protuberances of the discharge vessel and the outer bulb. This results in a reduction of the voltage at which a magnetically induced discharge is obtained. The electrical coil may then be carried, for example, by the protuberance of the outer bulb.

The lamp according to the invention may have a heat-resistant envelope of electrically insulating material for the body of soft magnetic material between said body and the discharge space. As a result, heat transport by radiation to the magnetic body can be still further limited. The heat-resistant envelope may be made of synthetic material, for example of fluorinated hydrocarbon polymer or of aerogel, such as $Al_2O_3$ and $SiO_2$ aerogel, which may be modified with, for example, $Fe_3O_4$. Such aerogels may be prepared by hydrolysis and polymerisation of alcoholates in alcoholic solutions and by drying the reaction product at elevated temperature and pressure. The preparation of $SiO_2$ - aerogels is e.g. described in The Journal of Non-Crystalline Solids 82 (1986) 265–270.

BRIEF DESCRIPTION OF THE DRAWING

Embodiments of the lamp according to the invention are shown in the drawing. In the drawing.

DETAILED DESCRIPTION OF THE INVENTION

Figure 1:
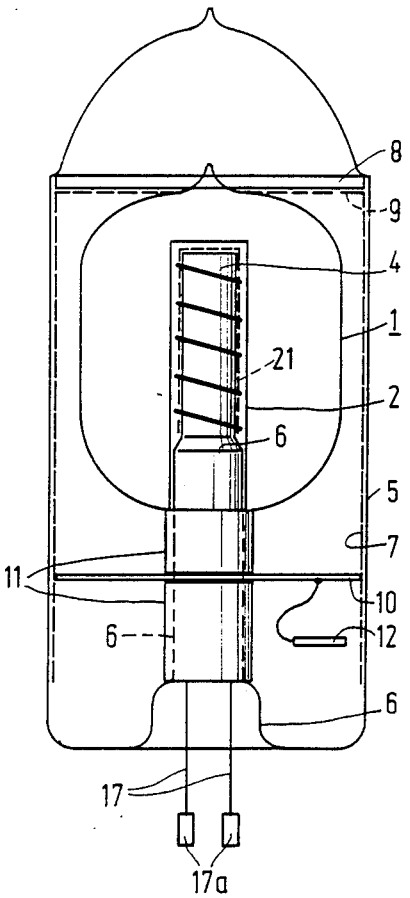
FIG. 1 is a side elevation of a first embodiment.

In FIG. 1, a discharge vessel 1 sealed in a vacuum-tight manner has a discharge space containing ionizable vapor and rare gas and a protuberance 2 for receiving a body or core of soft magnetic material, for example of ferrite, such as 4C6 ferrite, which cooperates with an electrical coil 4 surrounding the magnetic body.

The discharge vessel 1 contains sodium vapor and rare gas, for example argon, at a pressure at room temperature of 20 to 500 Pa, for example about 10 Pa.

The discharge vessel 1 is surrounded by an evacuated outer bulb 5, which has a protuberance 6 projecting into the protuberance 2 of the discharge vessel 1 so that the soft magnetic body can be received by the protuberance 6.

The electrical coil 4 adapted to cooperate with the soft magnetic body is situated in the evacuated space between the protuberances 2 and 6. The coil 4 is carried in the lamp shown by the protuberance 6.

The wall of the outer bulb 5 has a translucent coating 7 for reflecting IR radiation, for example comprised of tin-doped indium oxide.

The discharge vessel 1 is held positioned in the outer bulb 5 by a supporting plate 8 of, for example, quartz glass, which is provided with a translucent coating 9 for reflecting IR radiation so that the lamp emits light also in the axial direction, and by a supporting plate 10, for example of metal, which cooperates with sleeves 11 of, for example, quartz glass arranged to surround the protuberance 6.

By means of a holder 12, an evaporating getter, for example a barium getter, is introduced into the outer bulb 5.

A light-reflecting coating 21 is provided on the protuberance 6.

Current conductors 17 having contacts 17*a* at their free ends, extend through the wall of the protuberance 6 to the electric coil 4.

Figure 2:
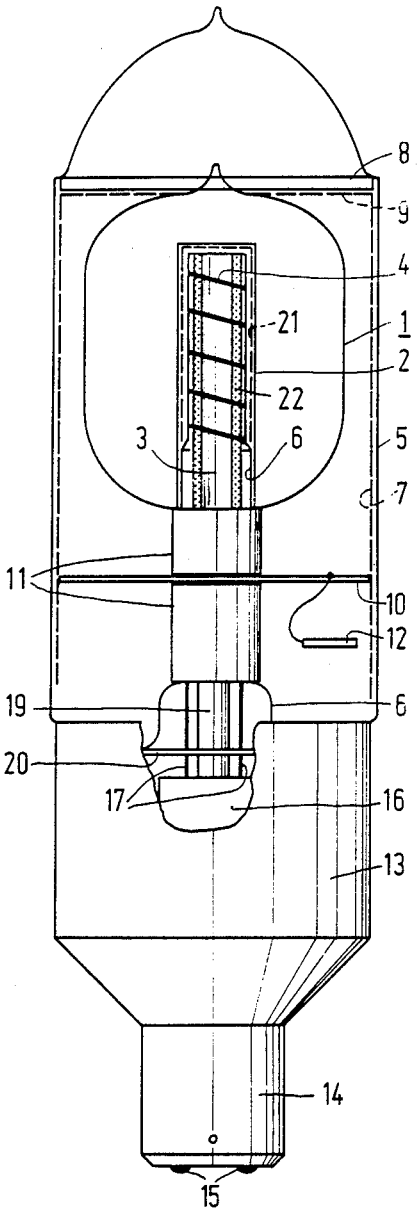
FIG. 2 is a side elevation of a second embodiment partly broken away.

In FIG. 2, parts corresponding to parts of FIG. 1 have the same reference numerals. The light reflecting layer 21 is situated on the inner side of the protuberance 2, however.

A housing 13 carrying a lamp cap 14 provided with contacts 15 surrounds a power supply unit 16 comprising a frequency converter having an output frequency of at least 1 MHz, which is connected to the contacts 15 and via current conductors 17 to the electrical coil 4.

A soft magnetic body or core 3 is situated in the protuberances 2,6 and has a heat-resistant envelope 22. The body 3 cooperates with the coil 4 surrounding said body 3.

The soft magnetic body 3 may be provided with a core of, for example, copper, which is connected via a rod 19 of synthetic material to a mounting plate 20 in the housing 13. Such a core ensures that the temperature of the body 3 is homogeneized; the rod 19 limits the amount of heat flowing away to the content of the housing 13.

A lamp of the kind shown in the drawing yielded during operation at 2.65 MHz 2450 lm at a power consumption of 16.9 W. The output therefore was 144 lm/W.

In a lamp of the kind shown in the drawing, the soft magnetic body had a diameter of 9 mm. The electrical coil has a diameter of 12 mm. The ignition voltage was 370 $V_{eff}$. With a similar lamp not in accordance with the invention, in which the electrical coil was wound onto the soft magnetic body and therefore was situated within the protuberance in the outer bulb and within the heat-resistant envelope, this ignition voltage was 440 $V_{eff}$ and the output was 144 lm/W. If in the last-mentioned lamp the heat-resistant envelope was emitted, the output decreased to 132 lm/W.

What is claimed is:

1. An electrodeless low-pressure discharge lamp comprising a discharge vessel sealed in a vacuum-tight manner and having a discharge space containing ionizable vapor and rare gas, the discharge vessel having an inwardly extending protuberance for receiving a body of soft magnetic material cooperating wth an electrical coil surrounding said body, characterized in that:

the discharge vessel is surrounded by an evacuated outer bulb for thermally isolating the discharge vessel, the outer bulb has a protuberance projecting into the protuberance of the discharge vessel, and said body of soft magnetic material is disposed in said protuberance of the outer bulb and external to said outer bulb for being thermally isolated from said discharge vessel.

2. An electrodeless discharge lamp as claimed in claim 1, characterized in that at least one of the protuberances is provided with a light-scattering layer.

3. An electrodeless low-pressure discharge lamp as claimed in claim 1, characterized in that the electrical coil adapted to cooperate with the body of soft magnetic material is situated in the evacuated space between the protuberances of the discharge vessel and the outer bulb.

4. An electrodeless low-pressure discharge lamp comprising:

a discharge vessel sealed in a vacuum-tight manner and having a discharge space containing ionizable vapor and rare gas, the discharge vessel having an inwardly extending protuberance for receiving a body of soft magnetic material, this body cooperating with an electrical coil surrounding said body, a housing connected to the discharge vessel and carrying a lamp cap with contacts, in which a supply unit is arranged comprising a frequency converter having an output frequency of at least 1 MHz and being connected to the contacts at the lamp cap and to the electrical coil, characterized in that, the discharge vessel is surrounded by an evacuated outer bulb, the outer bulb has a protuberance projecting into the protuberance of the discharge vessel, and the body of soft magnetic material is disposed within the protuberance of the outer bulb and is thermally isolated from the discharge vessel.

5. An electrodeless discharge lamp as claimed in claim 4, characterized in that at least one of the protuberances is provided with a light-scattering layer.

6. An electrodeless lamp as claimed in claim 4, characterized in that the electrical coil is situated in the evacuated space between the protuberances of the discharge vessel and the outer bulb.

7. An electrodeless lamp as claimed in claim 4 or 5, characterized in that the lamp has a heat-resistant envelope of electrically insulating material between the body of soft magnetic material and the discharge space.

8. An electrodeless low-pressure discharge lamp as claimed in claim 2, characterized in that the electrical coil adapted to cooperate with the body of soft magnetic material is situated in the evacuated space between the protuberances of the discharge vessel and the outer bulb.

9. An electrodeless lamp as claimed in claim 4, characterized in that the electrical coil is situated in the evacuated space between the protuberances of the discharge vessel and the outer bulb.

10. An electrodeless lamp as claimed in claim 9, characterized in that the lamp has a heat-resistant envelope of electrically insulating material between the body of soft magnetic material and the discharge space.

11. An electrodeless lamp as claimed in claim 5, characterized in that the lamp has a heat-resistant envelope of electrically insulating material between the body of soft magnetic material and the discharge space.

12. An electrodeless low-pressure discharge lamp comprising:

a sealed discharge vessel having an inwardly extending hollow elongate protuberance;

a vaporizable and ionizable fill material within said sealed discharge vessel for emitting light when ionized;

a sealed and evacuated outer envelope surrounding said sealed discharge vessel and defining an evacuated space between said discharge vessel and said outer envelope for thermally isolating said discharge vessel, said outer envelope having an elongate protuberance extending into said protuberance of said discharge vessel, and a portion of said protuberance of said outer envelope having a narrower outer diameter than the inner diameter of said protuberance of said discharge vessel and said evacuated space extending between said outer envelope protuberance and said discharge vessel protuberance;

a soft magnetic core disposed within said outer envelope protuberance and thermally isolated from said discharge vessel by the evacuated space; and a conductive coil disposed within the evacuated space between the respective protuberances and wound surrounding said magnetic core and being energizable for vaporizing and ionizing said fill material to cause the emission of light.

13. An electrodeless low-pressure discharge lamp according to claim 12, wherein:

said fill material is comprised of mercury and rare gas and said lamp is a low-pressure mercury vapor discharge lamp; and said evacuated outer envelope is effective to maintain the lowest temperature of said discharge vessel at least about 40° C. during lamp operation.

14. An electrodeless low-pressure discharge lamp according to claim 12, wherein:

said fill material is comprised of sodium and a rare gas and said lamp is a low-pressure sodium vapor discharge lamp; and said evacuated outer envelope is effective to maintain the lowest temperature of said discharge vessel at least about 260° C. during lamp operation.

* * * * *